United States Patent [19]

Greenhouse

[11] Patent Number: 4,777,054

[45] Date of Patent: Oct. 11, 1988

[54] EASY OPEN PACKAGE

[75] Inventor: Eugene L. Greenhouse, Latham, N.Y.

[73] Assignee: Perfect Holdings, Ltd., Sherman Oaks, Calif.

[21] Appl. No.: 927,599

[22] Filed: Nov. 6, 1986

[51] Int. Cl.[4] ..... B65D 17/28; B65D 17/40; B65D 27/34

[52] U.S. Cl. ..... 426/115; 206/609; 206/610; 206/614; 206/620; 206/615; 229/87 F; 426/122

[58] Field of Search ..... 426/115, 122, 130, 128, 426/123, 112, 615, 614, 609; 229/87 F, DIG. 7, DIG. 13; 206/620, 610, 611, 612

[56] References Cited

U.S. PATENT DOCUMENTS

| | | | |
|---|---|---|---|
| 1,180,542 | 4/1916 | Roden | 206/610 |
| 1,329,466 | 2/1920 | Miller | 206/620 |
| 1,436,754 | 11/1922 | Chadwick | 426/122 |
| 1,453,015 | 4/1923 | Lavigne | 206/610 |
| 1,516,090 | 11/1924 | Gary et al. | 206/620 |
| 1,628,429 | 5/1927 | Radford | 229/87 F |
| 1,669,237 | 5/1928 | Gingras | 229/87 F |
| 1,869,313 | 7/1932 | Mackay | 206/609 |
| 2,027,791 | 1/1936 | Schrager | 426/122 |
| 2,051,923 | 8/1936 | Vogt | 426/122 |
| 2,132,966 | 10/1938 | O'Brien | 426/130 |
| 2,143,646 | 1/1939 | Chapman | 206/614 |
| 2,839,183 | 6/1958 | La Rosa | 206/609 |
| 2,981,456 | 4/1961 | Armstrong et al. | 426/122 |
| 3,080,238 | 3/1963 | Kraft et al. | 426/130 |
| 3,095,088 | 6/1963 | Blaikie et al. | 206/610 |
| 3,114,643 | 12/1963 | Boston et al. | 426/113 |
| 3,131,848 | 5/1964 | Floyd | 206/611 |
| 3,179,327 | 4/1965 | Burton et al. | 206/610 |
| 3,259,235 | 7/1966 | Sowle | 206/628 |
| 3,260,358 | 7/1966 | Gottily et al. | 206/632 |
| 3,297,235 | 1/1967 | Robbins | 206/610 |
| 3,315,875 | 4/1967 | Pragtorius | 206/615 |
| 3,355,082 | 11/1967 | Wood | 426/115 |
| 3,356,210 | 12/1967 | Lilly | 206/611 |
| 3,419,137 | 12/1968 | Walck | 206/632 |
| 3,616,990 | 11/1971 | Powell | 206/610 |
| 3,652,008 | 3/1972 | Grotefend | 206/610 |
| 3,689,291 | 9/1972 | Draper | 426/113 |
| 3,873,738 | 3/1975 | Zoeller | 426/111 |
| 4,143,165 | 3/1979 | Daswick | 426/115 |
| 4,189,054 | 2/1980 | Liu et al. | 426/115 |
| 4,292,332 | 9/1981 | McHam | 426/113 |

FOREIGN PATENT DOCUMENTS

| | | | |
|---|---|---|---|
| 303252 | 8/1968 | Sweden | 206/610 |
| 659493 | 10/1951 | United Kingdom | 426/122 |

*Primary Examiner*—Steven Weinstein
*Attorney, Agent, or Firm*—Harvey S. Hertz

[57] ABSTRACT

A package unit includes, in combination, a generally elongated shaped food item for consumption when the package is open, and a container which surrounds and seals the elongated shaped food item. The container includes a first tear line formed adjacent to one end of the container along a plane generally perpendicular to the axis of the elongated shaped food item for opening the container. A second tear line is formed along the plane generally parallel to the food item for exposing one end of the food item after the container has been open by removing a portion of the container along the first tear line. The second tear line extends at one end from the center portion of the first tear line toward the other end of the container and terminates at its other end in a central section of the container. Third and fourth tear lines each extend at opposed angles from the other end of the container and are joined together adjacent the other end of the second tear line.

2 Claims, 1 Drawing Sheet

EASY OPEN PACKAGE

BACKGROUND OF THE INVENTION

1. Field of the Invention

The field of the art to which the invention pertains includes the field of packaging units and, more particularly, to a packaging unit which can be opened continuously and simultaneously with the consumption of the food item contained in the packaging unit.

2. Description of the Prior Art

Conventional packaging units particularly those for food consumption are normally designed so that the packaging unit is completely removed prior to consumption of the food. Typically, the food item is either sealed or covered with the packaging unit. However, none of the packaging units which are utilized for consumption of food while the food is contained within the packaging unit are designed for continuous removal of the packaging unit while the food is consumed in a manner which is simple for the user.

Typical packaging units utilize either perforations or strings for opening the package. Normally, the perforation or strings are formed along one or plurality of lines where openings should occur.

Known prior art includes U.S. Pat. Nos. 3,297,235; 3,095,088; 1,453,015; 1,180,542; 1,869,313; 3,616,990; 3,179,327 and 3,652,008.

A SUMMARY OF THE INVENTION

A packaging unit includes in combination a generally elongated shaped food item for consumption when the package unit is open and a container. The container surrounds and is sealed around the elongated shaped food item. The container includes a first tear line formed adjacent one end of the container along a plane generally perpendicular to the axis of the elongated shaped food item for opening the container. A second tear line is formed along a plane generally parallel to the axis of the food time for exposing one end of the food item after the container has been open by removing a portion of the container along the first tear line. The second tear line extends at one end from the central portion of the first tear line toward the other end of the container and terminates at its other end in a central section of the container. Third and fourth tear lines each extend at opposed angles from the other end of the containers and are joined together adjacent the other end of the second tear line.

The advantages of this invention, both as to its construction and mode of operation, will be readily appreciated as the same becomes better understood by reference to the following detailed description when considered in connection with the accompanying drawings in which like reference numerals indicate like parts throughout the figures.

DESCRIPTION OF THE PREFERRED EMBODIMENTS

Figure 1:
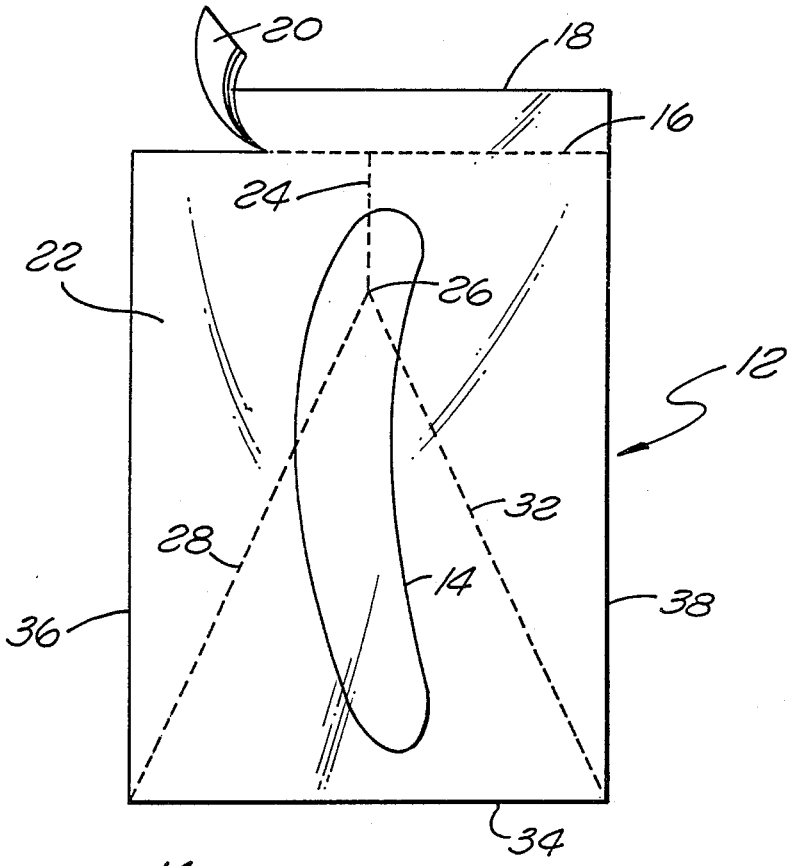
FIG. 1 is a perspective view illustrating the packaging unit containing a food item therein.

Referring now to the drawings, there is shown in FIG. 1, a packaging unit constructed in accordance with principles of the invention. The packaging unit consists of a container 12 illustrated as being of transparent plastic material. However, it should be understood that non-transparent material could be used as well, the transparency being illustrated merely for purposes of illustration only.

Positioned within the container 12 is an elongated food item illustrated as a banana 14. The packaging unit is normally thereafter sold to consumers who would consume the banana 14. In prior art packaging techniques, the container 12 would be opened in a random manner and consumption would occur either by totally removing the container from the food item or partially removing the container, also in a random manner.

In the present invention, a first tear line 16 is provided near the first end 18 of the container 12. Typically, the first tear line 16 and the end 18 are formed in parallel planes, and the container is opened by removing the portion 20 of the container between the first tear line 16 and the first end 18. Removal of the portion 20 from the container separates the container front side 22 from an identical rear side (not shown) along the first tear line 16.

Once removal of portion 20 has been accomplished, the container 2 is open and the banana 14 can either be removed therefrom or consumed as will be described hereinafter. The second tear line 24 which is formed on the front side 22 and the indentical rear side of the container enables the container to be further opened exposing one end of the elongated shaped banana 14.

Figure 2:
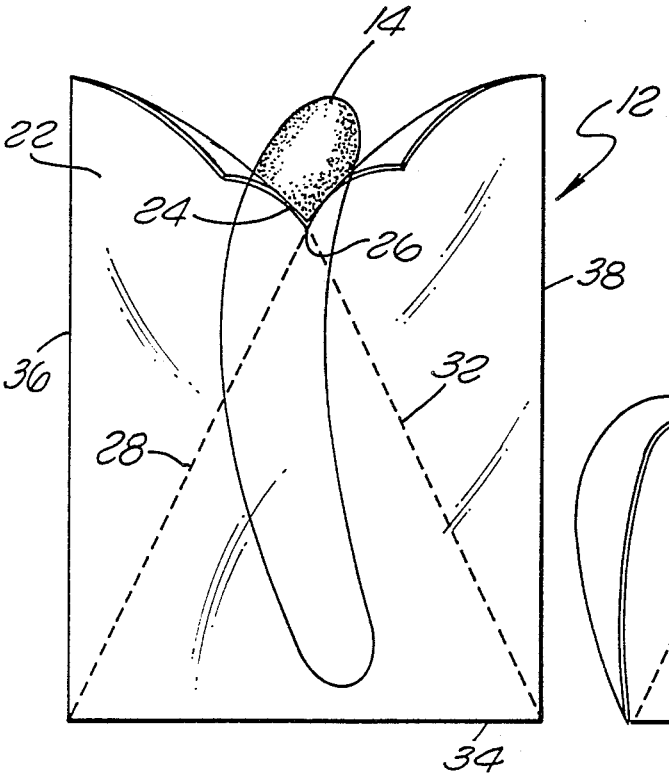
FIG. 2 is a perspective view of the packaging unit of FIG. 1 partially open.

As can be seen in FIG. 2, the portion 20 has been removed from the container and the second tear line 24 has been partially opened, thus exposing the one end of the banana 14. The second tear line 24 extends from the first tear line 16 to approximately ⅓ the length of the container 12 to a junction point 26 formed in the central section of the container. Then third and fourth tear lines 28 and 32 which extend from the junction point 26 at opposed angles to the second end of the container 34 at approximately the junction of the container sides 36, 28 and the container second end 34, respectively.

Figure 3:
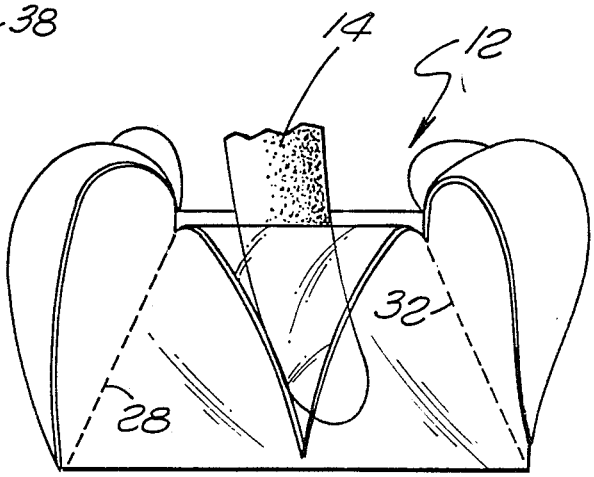
FIG. 3 is a perspective view of the package unit of FIG. 1 in a further open position.

As can be seen in FIG. 3, as the container second tear line 24 and the third and fourth tear lines 28 and 32 are separated, the container can be further folded back for further consumption of the banana. This "peel-away" configuration as shown in the drawings enables the user to utilize the container as a sanitary holder, exposing the food item as it is consumed.

The container 12 is normally formed from a flat sheet of paper using a conventional multi-roller process. The first roller is typically a perforation forming roller. The next rollers would each place different colors on the paper. Finally, a sealing roller is used which would combine or individually apply any one of the following: polypropelene; surlyn or food grade U.S.D.A. varnish.

While the container has been illustrated as being shown as being made of clear plastic, it should be understood that other paper or aluminum type products could be used as well, the invention relying primarily on the positioning of the tear lines in the container. In addition, while a banana has been illustrated as the food item, it should be understood, of course, that other food items other than a banana could be utilized in such a container packaging unit and can be at room temperature or frozen.

Further, while only four tear lines have been illustrated, it should be understood that additional tear lines could be formed on said container.

I claim:

1. A package unit comprising in combination;

a generally elongated shaped food item for consumption when said package unit is open;

a container surrounding and sealing said elongated shaped food items, said container being of generally rectangulr configuration and having a front side and rear side, each side including a corresponding first tear line formed at one end of said container along a plane generally perpendicular to the axis of said elongated shaped food items such that the portions of the front and rear sides between said tear lines and said one end are removable to separate the front side and the rear side and open the package;

a second tear line formed on each of said sides along a plane generally parallel to the axis of said food item for exposing one end of said food item after said container has been opened by removing a portion of the said container along said first tear lines, said second tear lines extending at one end from the central portion of said first tear lines toward the other end of said container and extending toward its other end to at least a central section of said container; and third and fourth tear lines formed on each of the container sides, each extending at opposed angles from each other at said other end at opposite corners of said other end of said container and joining together adjacent said second tear line in said container central section such that as said second tear lines and said third and fourth tear lines are separated, said container can be folded back toward said other end to expose said food item in a peel away fashion.

2. A package unit in acordance with claim 1 where said first tear lines extend along the entire length of said container one end.

* * * * *